United States Patent [19]

Petrini

[11] Patent Number: 4,575,957

[45] Date of Patent: Mar. 18, 1986

[54] REAR ENTRY SKI BOOT

[75] Inventor: Roland Petrini, Chambery, France

[73] Assignee: Salomon S.A., Annecy, France

[21] Appl. No.: 617,204

[22] Filed: Jun. 4, 1984

[30] Foreign Application Priority Data

Jun. 8, 1983 [FR] France ..... 83 09487

[51] Int. Cl.[4] ..... A43B 5/04

[52] U.S. Cl. ..... 36/121; 36/105; 36/50

[58] Field of Search ..... 36/117–121, 36/105

[56] References Cited

U.S. PATENT DOCUMENTS

| | | | |
|---|---|---|---|
| 3,713,231 | 1/1973 | Mochizuki | 36/121 |
| 3,803,730 | 4/1974 | Hanson et al. | 36/117 |
| 4,265,034 | 5/1981 | Salomon | 36/121 |

FOREIGN PATENT DOCUMENTS

| | | | |
|---|---|---|---|
| 0053340 | 11/1981 | European Pat. Off. | 36/120 |
| 2436575 | 4/1980 | France | 36/117 |

*Primary Examiner*—James Kee Chi

*Attorney, Agent, or Firm*—Pollock, Vande Sande & Priddy

[57] ABSTRACT

Ski boot of the rear entry type, comprising an upper constituted by a forward cuff (4) solid with the shell (2) of the boot and open to the rear, and by a rear hood (9) swingable about two axes (8) of articulation located on either side of the lower part of the shell, these two elements being assembled to one another by a single hook located in the vicinity of the top end of the upper. The rear hood (9) is in two parts, viz., an upper channel-shaped part (**9*b*) to be inserted into the interior of the cuff (4) between the edges (7) of the latter, and a yoke-shaped lower part (9*a*), covering the lower portion of these edges (7) and fixed for pivoting movement outside the cuff (4) on the two axes (8) of articulation, the join (11**) between these two parts straddling, on each side, the corresponding edge of the cuff.

4 Claims, 5 Drawing Figures

REAR ENTRY SKI BOOT

SUMMARY OF THE INVENTION

The present invention relates to a ski boot, of the rear entry type, i.e., whose upper opens by rearward swinging movement of one or several elements, such that the skier's foot is inserted into the boot through the rear thereof, closure taking place by returning the said element(s) toward the front and making them solid with the fixed portion of the upper by one or several hooks.

BACKGROUND OF THE INVENTION

Swiss Pat. No. 491,620 discloses a boot whose upper is surrounded by a cuff articulated on two lateral axes located in the vicinity of the base of the heel, the cuff opening at its upper portion and being provided at that location with a closure hook. To free said hook, the cuff is opened, separating its two edges, and swings rearwardly allowing the foot to be inserted into the boot. One disadvantge of this structure is that the cuffs, being split toward the front, is not rigid enough when the skier is in bent position toward the front. It is also not possible to make the cuff more rigid, since then it becomes more difficult for the skier to separate the edges of the cuff in order to permit it to swing rearwardly when the boot is to be put on or taken off.

Swiss Pat. No. 548,745 describes a boot whose upper is in two parts, viz., a first cuff part which is an integral part of the boot and open toward the back, and a second part constituted by a movable rear hood, articulated to the sole by a flexible tongue, the rear hood covering the rearward opening in the first part. In closed position, the rear hood in inserted between the edges of the cuff. This arrangement makes it possible to give the rod excellent resistance to forward bending, but has the disadvantage that it requires several hooks to produce good interlocking of the rear hood and the cuff, and tightness at the base of the hood even when the skier is in rearward position.

It has also been suggested to form the upper in two parts articulated to one another via two lateral lower axes, either by providing that the rear hood covers the edges of the rear opening of the cuff (see U.S. Pat. No. 3,883,964), or by providing that the rear hood is engaged between the rear edges of the cuff. In the first case, it is indispensable to provide at least two hooks in order to prevent the outer edges of the hood from gaping, to the detriment of the rigidity and tightness of the upper. In the second case, which is the one used by applicant in its manufacture, a single hook placed at the top of the upper suffices to assure superior tightness and resistance to buckling of the cuff.

OBJECT OF THE INVENTION

The object of the present invention is an improvement in this type of closure for ski boots, designed not only to improve resistance to buckling of the cuff while maintaining tightness, but also to permit the positioning of means for lateral adjustment of the hood, despite the use of only a single closure hook.

The ski boot according to the present invention comprises an upper constituted by a forward cuff solid with the shell of the boot and open to the rear, and by a rear hood swingable about two axes of articulation located at the lower part of the shell, these two elements being assembled by tightening means located near the top of the upper. The rear hood has two parts, namely, an upper, channel-shaped part to be inserted into the interior of the cuff between the edges of the latter, and a yoke-shaped lower part covering the lower edges of the cuff and fixed for pivoting movement outside the cuff on the two axes of articulation, the join between these two parts straddling, on each side, the corresponding edge of the cuff.

BRIEF DESCRIPTION OF THE DRAWINGS

In order that the invention may be more clearly understood, reference will now be made to the accompanying drawings, in which several embodiments are shown for purposes of illustration, and in which.

DESCRIPTION OF PREFERRED EMBODIMENT

Figure 3:
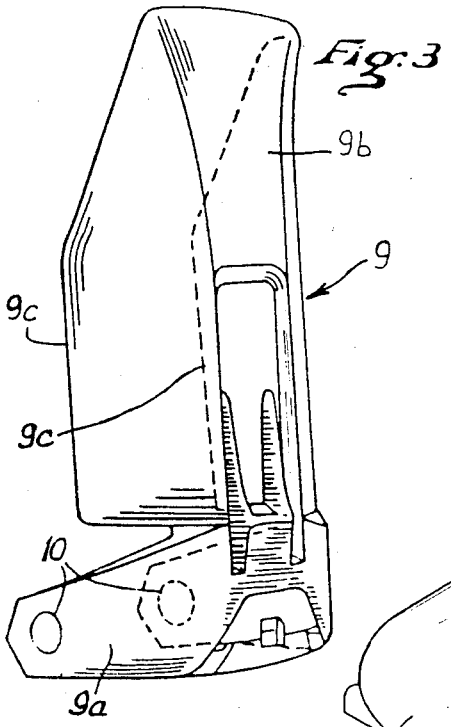
FIG. 3 is a perspective view of the rear hood shown in FIG. 1.
Figure 1:
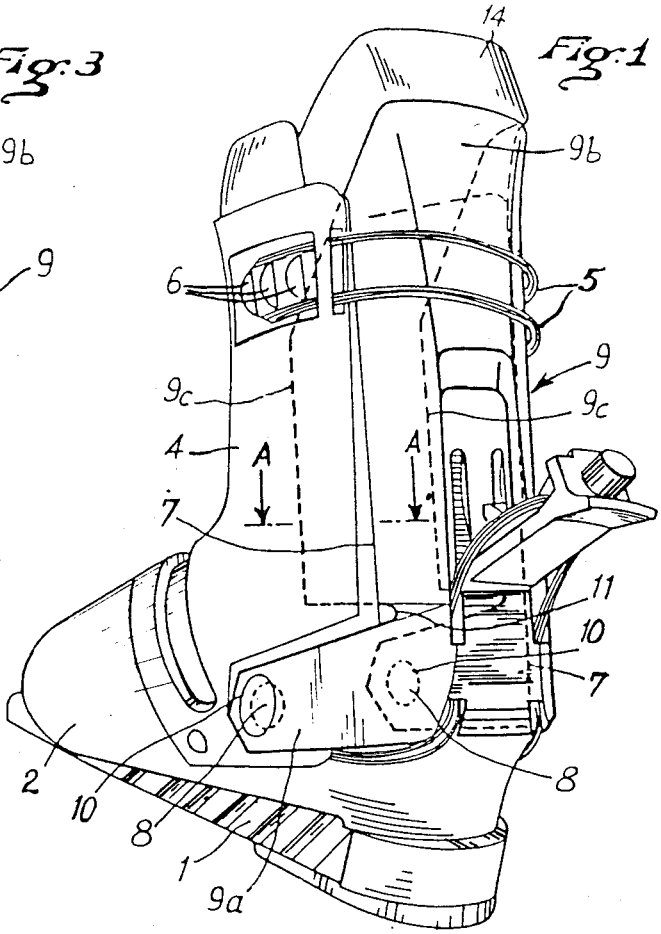
FIG. 1 is a perspective view of a first embodiment of the invention.
Figure 2:
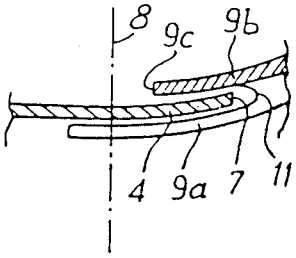
FIG. 2 is a detail view along line A—A of FIG. 1.

With reference to FIGS. 1 to 3, the ski boot according to the invention comprises a sole 1 solid with a shell 2 to which it is attached by two rivets (one on each side of the shell), a front cuff 4 which carries at its upper end conventional tightening means constituted by a hook (not shown) exerting traction on a cable in buckle 5, the end of which is engaged in a selected one of a plurality of slots 6. The cuff 4 is open at the rear along its entire height, this opening being defined by two borders 7, the left border being shown in full lines and the right border in dotted lines in FIG. 1.

In the vicinity of its base and near the rivets, cuff 4 comprises two axes of articulation 8 on each side of the cuff, the left-hand axis being shown in full lines and the right-hand axis in dotted lines.

The rear opening of cuff 4 is closed by a rear hood 9, which comprises a lower part **9*a* constituted by a yoke each of whose branches is provided at its end with an orifice 10 traversed by one of the axes of articulation 8. This yoke 9*a* is located outside the cuff 4, such that each of its branches passes over the edges 7** of the cuff opening.

Above yoke **9*a* is located the upper portion 9*b* of rear hood 9, this portion 9*b* being channel-shaped and being inserted at the interior of cuff 4, in such manner that the edges 7 of the cuff are above this portion 9*b*, while the edges 9*c* of portion 9*b* are inside cuff 4**.

The connection 11 between portions **9*a* and 9*b* straddles edge 7 corresponding to cuff 4**.

Figure 4:
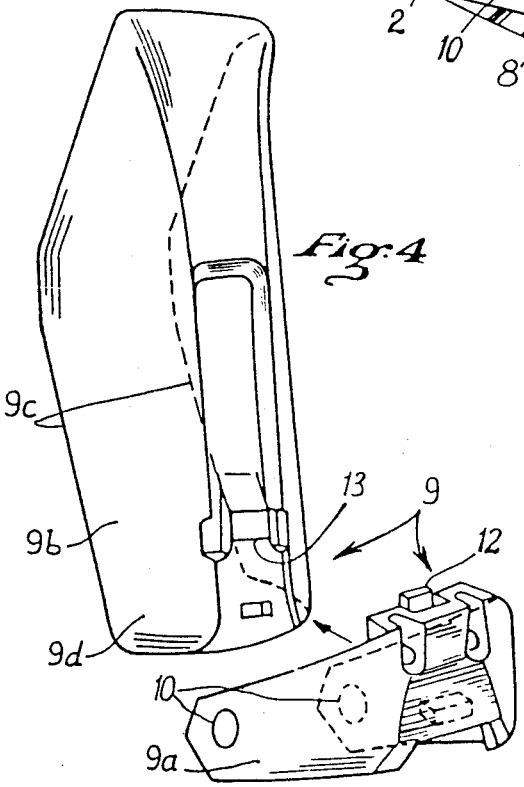
FIG. 4 is an exploded view of a second embodiment of the invention.

In the embodiment shown in FIGS. 1 to 3, the rear hood is molded in a single piece. In the embodiment shown in FIG. 4, this piece has two separate parts. In this embodiment, the rear central portion of yoke **9*a* comprises a small tongue 12 which lodges in a corresponding recess 13 in the rear middle portion of part 9*b*. It can be seen that part 9*b* comprises near its bottom a prolongation 9*d* which descends inside cuff 4 to the level of yoke 9*a***, which itself is outside the cuff. This produces improved support for the back of the skier's leg.

Figure 5:
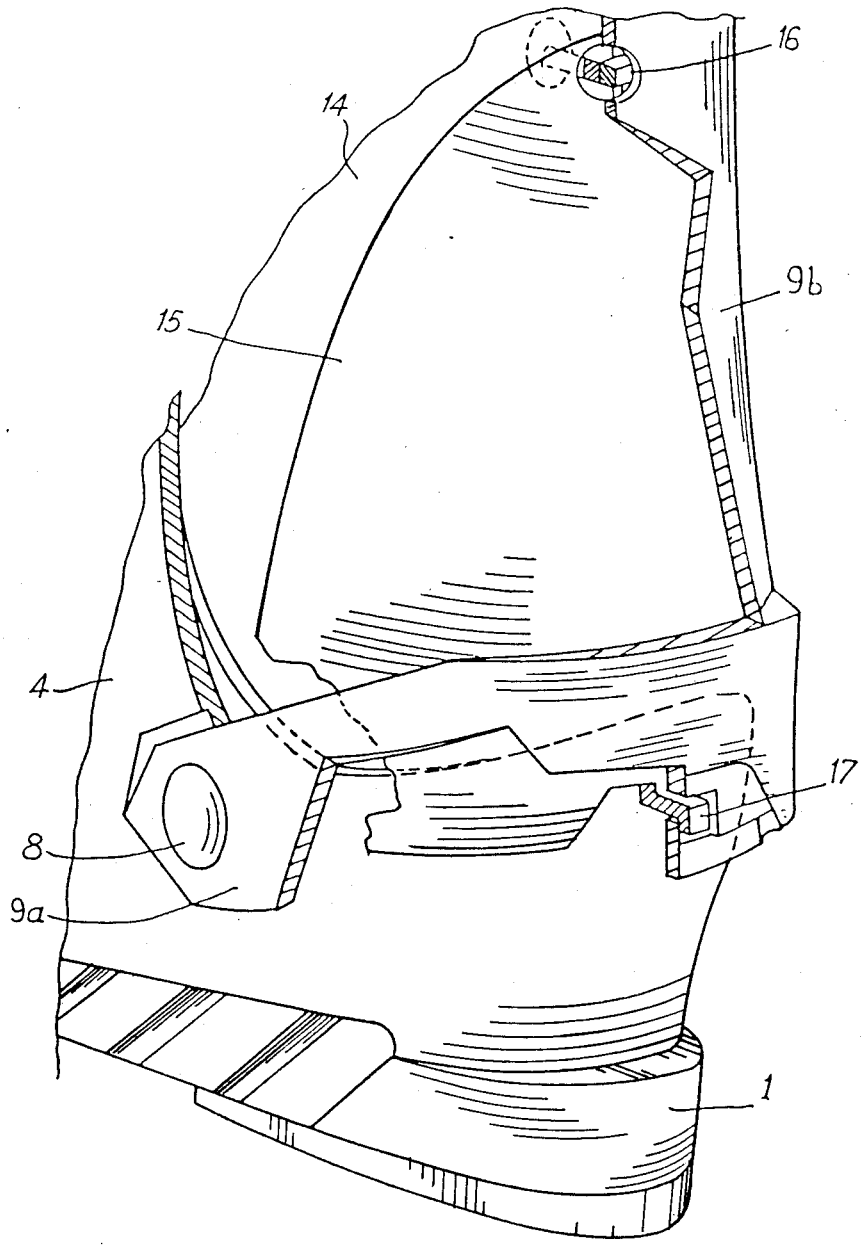
FIG. 5 shows a variant of either the first or second embodiment.

FIG. 5 shows a variant applicable to both the first and second embodiments of the invention. According to this variant, between rear hood 9 and a lining or slipper 14 is located a shell 15 which is attached to hood 9 by two attachment lugs 16 and 17, located respectively at the top and bottom of shell 15.

The disclosed structure makes it possible to avoid buckling of cuff 4, since its edge 7 is contained at its lower portion by the lateral walls of yoke 9*a*. In effect, this lower portion of the cuff is the region most likely to be sufject to deformations during bending movements of the skier.

Furthermore, the presence of yoke 9*a*, which is outside cuff 4, permits the positioning of lateral adjustment means for said yoke.

When the rear hood is in two parts, yoke 9*a* can be made of a material which is more rigid than that of which part 9*b* is made, and/or of a material which is better suited mechanically as regards friction, adjustment, etc.

The presence of intermediate shell 15 improves the support of rear hood 9 against the back of the skier's leg.

Finally, the structure according to the invention enables positioning of a conventional lateral adjustment means at the level of axes 8 and the ends of the two branches of the yoke, while at the same time improving resistance of the cuff to buckling. The adjustment means consists of locating the axis of articulation 8 in a support which can be immobilized at different heights, to thereby tilt the cuff laterally. The particular configuration of rear hood 9 described hereinabove provides access to and easier manipulation of the lateral adjustment mechanism, because yoke 9*a* on which this mechanism is located surrounds the cuff on its exterior.

What is claimed is:

1. Rear entry type ski boot having a shell, comprising (a) an upper comprising a forward cuff (4) having edges (7) and solid with said shell and open to the rear, and a rear hood (9) swingable about two axes of articulation (8) located on either side of the lower portions of said shell, said cuff and hood being assembled to one another by a single tightening means located near the top of said upper;

(b) said rear hood comprising an upper, channel-shaped portion (9*b*) for insertion into said cuff between said edges of the latter, and a yoke-shaped lower portion (9*a*) covering the lower portion of said edges (7) of said cuff (4) and pivotally attached to the exterior of said cuff on said axes of articulation (8), a join between said portions (9*b*, 9*a*) straddling, on each side, the corresponding edge of said cuff;

(c) said upper portion (9*b*) extending inside said boot, substantially to the level of said lower portion (9*a*) outside said boot.

2. Ski boot according to claim 1, wherein said rear hood is molded in one piece.

3. Ski boot according to claim 1, comprising means (11, 12) for assembling said upper portion (9*b*) to said lower portion (9*a*) of said rear hood (9).

4. Ski boot according to any one of claims 1 to 3, comprising an intermediate shell (15) between said rear hood (9) and a lining (14) of said boot, said intermediate shell being attached to said rear hood by two lugs (16, 17) located respectively adjacent the top and bottom of said intermediate shell.

* * * * *